US005201659A

United States Patent [19]

Nelson

[11] Patent Number: 5,201,659

[45] Date of Patent: Apr. 13, 1993

[54] MOTORIZED GYMNASTIC TRAINING APPARATUS

[76] Inventor: Riley H. Nelson, 5504 Alhambra Dr., Orlando, Fla. 32808

[21] Appl. No.: 936,345

[22] Filed: Aug. 28, 1992

[51] Int. Cl.[5] ..... G09B 19/00

[52] U.S. Cl. ..... 434/255; 434/247; 180/181; 280/87.042; 482/23; 482/142

[58] Field of Search ..... 434/247, 258, 255; 180/180, 181, 11; 280/87.042, 43, 43.17; 482/142, 146, 147, 23

[56] References Cited

U.S. PATENT DOCUMENTS

| | | | |
|---|---|---|---|
| 3,630,540 | 12/1971 | Smith | 482/146 X |
| 4,073,356 | 2/1978 | Schlicht | 180/181 |
| 4,505,477 | 3/1985 | Wilkenson | 482/146 |
| 5,062,630 | 11/1991 | Nelson | 280/87.042 X |

*Primary Examiner*—John J. Wilson
*Assistant Examiner*—Jeffrey A. Smith
*Attorney, Agent, or Firm*—William M. Hobby, III

[57] ABSTRACT

A motorized gymnastic training apparatus has first and second planar support members and a central support member attached through the first planar support member into the second planar support member. The central support member has a wheel rotatably mounted on one end thereof. The central support member may have a central sleeve attached through the first support member with a sliding or telescoping member passing therethrough so that the wheel and the second planar support member can be adjusted relative to the first planar support member with a pin locking the sleeve to the telescoping central support member. An electric motor is positioned within the central support member and is coupled to the wheel through a belt and a pair of pulleys attached to the wheel shaft and to the electric motor shaft for rotating the wheel in a forward or backwards rotation responsive to the actuation of a switch. The switch can be mounted on the second planar support member so that a person using the gymnastic training apparatus can actuate the switch to an on/off position or to a forward or reverse direction. A plurality of removable secondary wheels can be attached to the first planar support member for use in training an individual to use the gymnastic training device after which time the secondary wheels can be removed.

12 Claims, 2 Drawing Sheets

MOTORIZED GYMNASTIC TRAINING APPARATUS

BACKGROUND OF THE INVENTION

This invention relates to a gymnastic training apparatus for use to develop upper body muscles and to teach coordination and balance and more particularly relates to a motorized gymnastic training apparatus.

Recreational devices such as unicycles, bicycles and skateboards are intended for operation with the user either seated or standing in an upright position. These devices result in the user developing coordination and strength for the lower body while the user is in an upright position. A disadvantage of such devices is that they do not provide the user with the means to develop balance, coordination and strength in the upper body while the user is upside down.

Training devices such as the parallel bars or the rings are intended for operation while the user is at times upside down. A disadvantage of these devices is that they are not easily portable. Further, such devices are either in a fixed position when they are in use (such as the parallel bars) or the device is only permitted a limited amount of movement when in use (such as the rings). Thus, another disadvantage of these devices is that they are not freely mobile when they are in use and thus do not permit the user the opportunity to develop balance coordination and strength in the upper body while the user is upside down and mobile. A further disadvantage of such devices is that they are not easily moved from one location to another.

In contrast to these prior art devices, the gymnastic training device of the present invention is specifically for training a person by the person grasping handles or surfaces with his hands and while balanced on his hands, manipulate the training device on a single central wheel and includes a motorized wheel which can be actuated by the hand of the user while balanced on his hands and which motorized wheel can be raised and lowered as desired by the user.

SUMMARY OF THE INVENTION

A motorized gymnastic training apparatus has first and second planar support members and a central support member attached through the first planar support member and to the second planar support member. The central support member has a wheel rotatably mounted on one end thereof. The central support member may have a central sleeve attached through the first support member with a sliding or telescoping member passing therethrough so that the wheel and the second planar support member can be adjusted relative to the first planar support member with a pin locking the sleeve to the telescoping central support member. An electric motor is positioned within the central support member and is coupled to the wheel through a belt and a pair of pulleys attached to the wheel shaft and to the electric motor shaft for rotating the wheel in a forward or backwards rotation responsive to the actuation of a switch. The switch can be mounted on the second planar support member so that a person using the gymnastic training apparatus can actuate the switch to an on/off position or to a forward or reverse direction. A plurality of removable secondary wheels can be attached to the first planar support member for use in training an individual to use the gymnastic training device after which time the secondary wheels can be removed.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
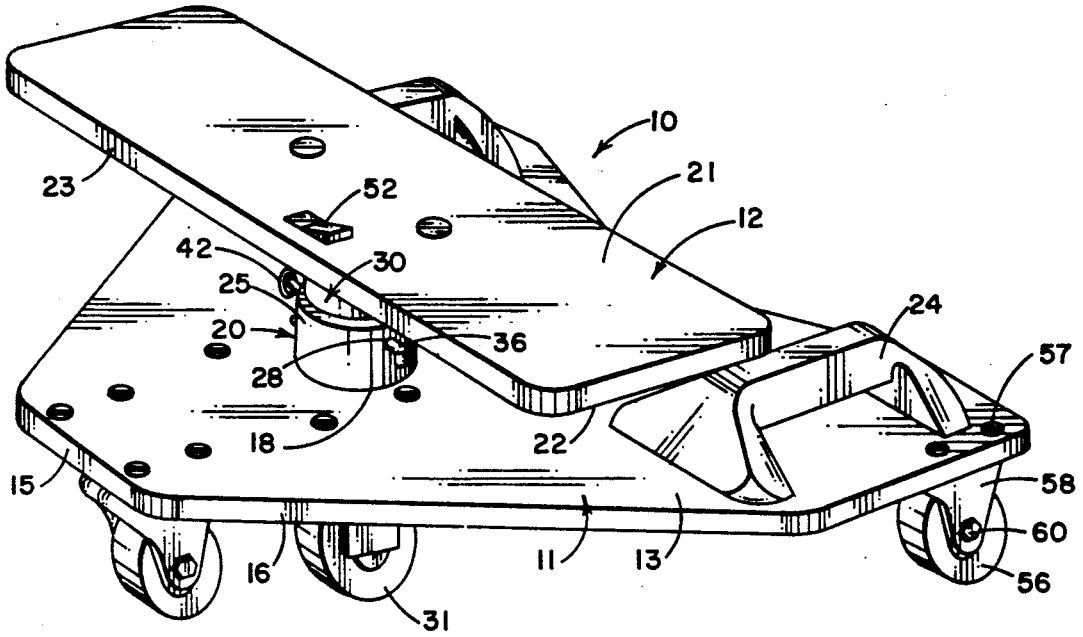
FIG. 1 is a perspective view from above of a gymnastic training apparatus in accordance with the present invention.

Referring to the drawings FIGS. 1-4, a gymnastic training device 10 is illustrated having a first planar support 11 and a second planar support 12. The first planar support 11 has a top side 13 and a bottom side 14 and has a wing shape having a flat nose 15 intersected by angular edges 16 and a generally V-shaped cutout 17 on the rear side thereof. The first support member 11 has an opening 18 passing therethrough and has a central support member 20 passing through the opening 18. The second or top planar support member 12 has a top side 21 and a bottom side 22 along with a plurality of edges 23. The bottom planar support member 11 can be seen to have a pair of handles 24 attached onto the top side 13 thereof and spaced at opposite sides of the top surface 13.

The central support member 20 can be seen having a main support sleeve 25 having a flange 26 attached to the bottom 14 of the first planar support 11 with a plurality of nuts and bolts 27. The sleeve 25 extends through the opening 18 in the planar support and is bolted to the planar support with the flange 26 from the bottom side. Sleeve 25 has a pair of apertures 28 extending therethrough and has a central telescoping portion 30. Telescoping portion 30 has a rotating wheel 31 mounted on one end with a shaft 32 through the center axis of the wheel 31 and attached to the central support housing portions 34. The wheel can also be seen having a pulley 33 attached over the shaft and to the side of the wheel 31. The central support inner sleeve 30 can be seen as telescoping through the sleeve 25 and being attached to the second planar support 12 bottom surface 22 so that the planar support 12 telescopes up and down with the telescoping portion 30.

Figure 4:
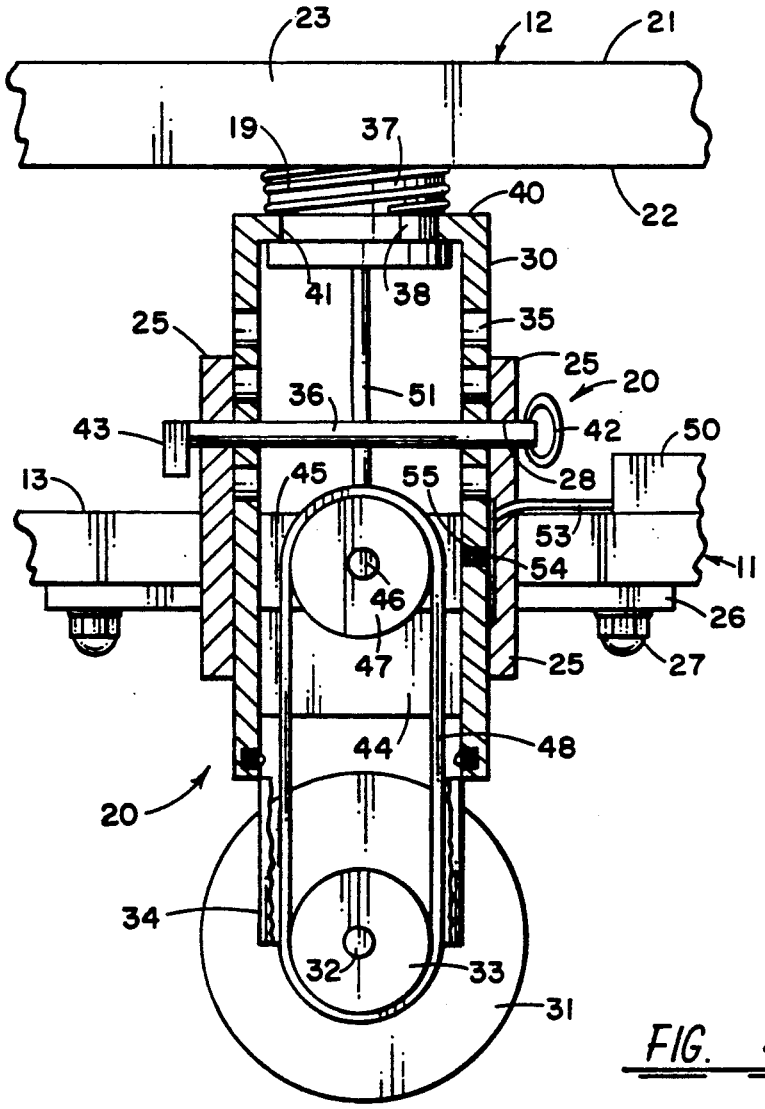
FIG. 4 is a partial sectional view on an enlarged scale of the apparatus of FIGS. 1-3.

The telescoping portion 30 has a plurality of apertures 35 therethrough for receiving a locking pin 36 through the openings 28 and through the sleeve 25 and through the openings 35 in the inner housing 30 as more clearly seen in FIG. 4. Also seen in FIG. 4 is an attaching member 37 attached to the second planar support 21 and having an annular groove 38 therearound and having the top 40 and the housing 30 having an annular opening 41 therein coupled into the groove 38 to provide the planar support 12 with an attachment which allows the support to rotate on the central support 20. A coil spring 19 wraps around member 37 and is compressed between top 40 and the bottom 22 of the second planar support 12. The inner housing 30 can be slid up and down in the outer sleeve 25 into a desired position aligning the holes 28 with one of the holes 35 and sliding the pin 36 therethrough to lock the telescoping central support member 20 in a predetermined position. Moving the sleeve 30 within the sleeve 25 raises and lowers the wheel 31 as well as raises and lowers the top support 12 relative to the bottom support 11. The locking pin 36 has a ring 42 on one end and a hinge end 43 to prevent the pin 36 from slipping out during use.

As more clearly seen in FIG. 4, a DC electric motor 44 has been attached to the inside of the sleeve housing 30 which motor 44 has a gear box portion 45 on the top thereof having an output motor shaft 46 extending from one side of the motor 44 and attached to a pulley 47 for rotating the pulley. Rotation of the pulley in turn moves the flexible belt 48 which may be an O-ring type drive belt which is attached around the pulley 47 and around the pulley 33 to rotate the pulley 33 and its attached wheel 31. The DC motor 44 is a reversible motor and is coupled to a battery pack 50 mounted on the surface 13 of the planar support member 11. The motor is connected through a plurality of conductors 51 to the three position rocker switch 52 mounted in the top planar support member 21. Switch 52 normally blocks the passage of current through the conductors 51 and can be rocked in one or the other direction to change the polarity of the current passing through the conductors 51 which conveys it back through the battery compartment 50 has conductors 53 which pass through the sleeve 25 to a small elongated connector plate 54 mounted on the inside of the sleeve 25. An insulated spring loaded ball contact 55 is seen passing through the housing 30 and connected to the electric motor 44. The sliding connector 54 and 55 allows the electric motor 44 mounted in the housing 30 to slide with the housing 30 as it is raised and lowered in the different positions allowing the ball contact 55 to maintain contact with the connector strip 54 so that power can be directed to the electric motor in any position of the telescoping member 30 within the sleeve 25. The contact 55 and contacting surface 54 will always be in alignment because the pin 36 will have to be inserted in one of the holes 35 which are in a column to always align the motor contactors.

Figure 2:
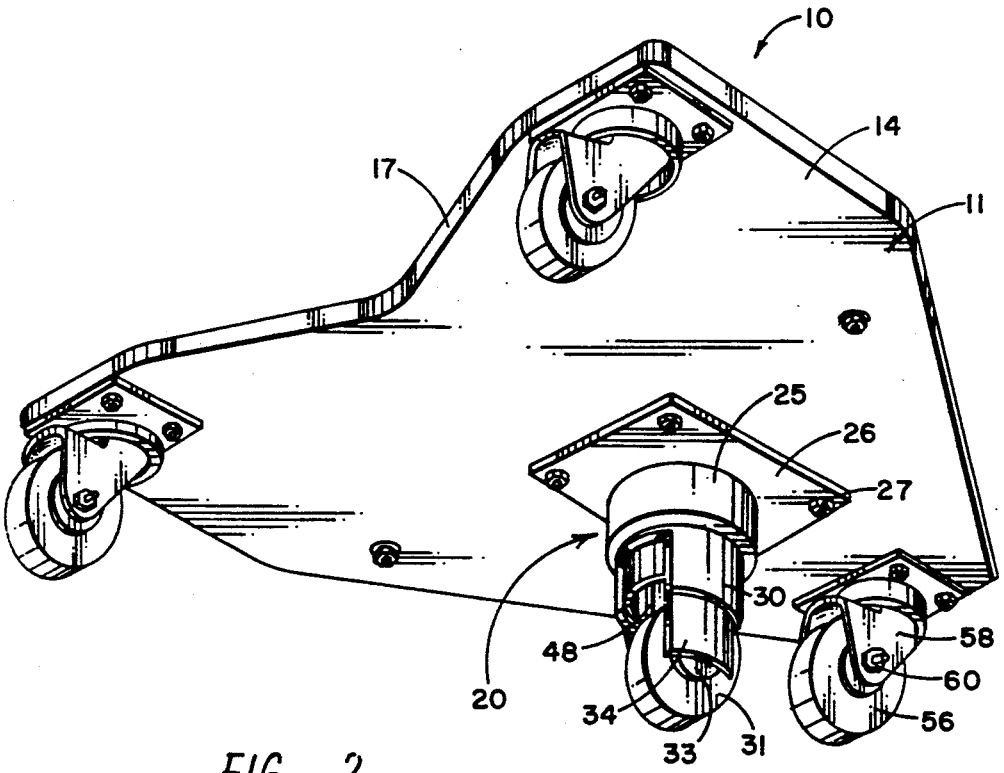
FIG. 2 is a perspective view from below of the apparatus of FIG. 1.
Figure 3:
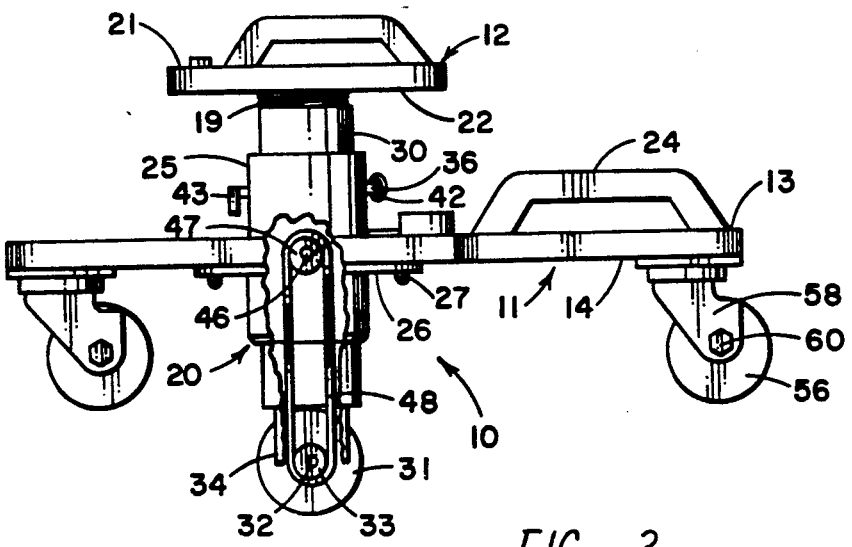
FIG. 3 is a side elevation with portions cutaway of the apparatus of FIGS. 1 and 2 showing the motor drive.

Referring to FIGS. 1, 2 and 3, a plurality of auxiliary or secondary wheels 56 are mounted in outboard positions with threaded fasteners 57 attached to yokes 58 and through axles 60 to allow the wheels 56 to rotate thereon. The plurality of outboard wheels can be removed by removing the threaded fasteners 57 and are used only for training prior to learning to use the device with only the single central wheel 31.

In operation, a user grasps either the edges of the second planar support 12 with his hand and, while standing in a handstand, can roll on the wheel 31 and can actuate the switch 52 in a forward or reverse direction to rotate the wheel in a forward or reverse direction while rapidly changing directions are desired. In addition, he can rotate the support 12 and can grasp the handles 24 on the lower support 11 and can form a variety of exercises and gymnastic training skills to develop both the skills and strength to perform handstands and other acrobatic maneuvers. The training device of the present invention is particularly suited for developing upper body muscles and to teach the user coordination and balance when they are upside down and allows the use of a single finger or thumb to manipulate the power in a forward or rearward direction and can be used with or without the wheels 56. However, the present invention is not to be construed as limited to the forms shown which are to be considered illustrative rather than restrictive.

I claim:

1. A gymnastic training device comprising:

first planar support member having an upper side and a lower side;

second planar support member having an upper side and a lower side;

central support member having first and second ends and having outer sleeve attached through said first planar support, said central support member having a flange attached thereto between the ends thereof, said flange being attached to said first planar support, and said central support member having an inner housing slidable in said outer sleeve, said inner housing having two ends, one end thereof being attached to said second planar support;

at least one wheel rotatably attached to one of said ends of said central support member;

electric drive means, including an electric motor mounted in said central support member and coupled to said wheel for powering said wheel;

an electric power source coupled to said electric drive means and providing electric power to said electric drive means; and a switch mounted on said second support member and electrically coupled to said electric drive means for actuating said electric drive means.

2. A gymnastic training device in accordance with claim 1 in which said electric motor has a shaft extending therefrom having a pulley attached thereto and said wheel has a pulley attached thereto and coupled to said motor shaft pulley with a drive belt.

3. A gymnastic training device in accordance with claim 2 in which said electric power source includes at least one battery supported in a battery pack.

4. A gymnastic training device in accordance with claim 3 in which said battery housing is attached to said first planar support member.

5. A gymnastic training device in accordance with claim 4 in which said battery is electrically coupled through said outer sleeve to said electrical motor with an electrical slide connector.

6. A gymnastic training device in accordance with claim 5 in which said electrical slide connector has an elongated conductor strip mounted on the inside surface of said outer sleeve and said inner housing has an electrical contact positioned to maintain contact with said elongated conductor strip as said electric motor and inner housing positions are shifted in said outer sleeve.

7. A gymnastic training device in accordance with claim 6 in which said electrical slide connector electrical contact includes a spring loaded conductor sphere biasing said sphere onto said elongated conductor strip.

8. A gymnastic training device in accordance with claim 1 in which said central support member outer sleeve has a pair of apertures therein and said inner housing has a plurality of apertures therein and a positioning pin is positioned through said outer sleeve apertures and through selected inner housing apertures to thereby set the position of said inner housing and the wheel attached thereto relative to said first planar support member.

9. A gymnastic training device in accordance with claim 1 in which said switch is a multiple position rocker switch for actuating said electric motor in a forward or reverse rotation.

10. A gymnastic training device in accordance with claim 1 in which said second planar support is rotatably mounted to said central support member for rotation thereon.

11. A gymnastic training device in accordance with claim 10 in which said first support member has a pair of handles thereon.

12. A gymnastic training device in accordance with claim 1 in which a plurality of second wheels are removably mounted to said first planar support.

* * * * *